US009745817B2

(12) United States Patent
Lyle et al.

(10) Patent No.: US 9,745,817 B2
(45) Date of Patent: Aug. 29, 2017

(54) INTERNAL TIEBACK WITH OUTER DIAMETER SEALING CAPABILITY

(71) Applicant: Vetco Gray Inc., Houston, TX (US)

(72) Inventors: Rockford Dee Lyle, Houston, TX (US); Joseph William Pallini, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 0 days.

(21) Appl. No.: 14/864,457

(22) Filed: Sep. 24, 2015

(65) Prior Publication Data

US 2016/0265297 A1 Sep. 15, 2016

Related U.S. Application Data

(60) Provisional application No. 62/055,238, filed on Sep. 25, 2014.

(51) Int. Cl.

| | |
|---|---|
| ***E21B 29/12*** | (2006.01) |
| ***E21B 43/01*** | (2006.01) |
| ***E21B 23/00*** | (2006.01) |
| ***E21B 43/10*** | (2006.01) |
| ***E21B 33/038*** | (2006.01) |
| ***E21B 17/01*** | (2006.01) |

(Continued)

(52) U.S. Cl.

CPC ..... *E21B 33/038* (2013.01); *E21B 17/01* (2013.01); *E21B 19/004* (2013.01); *E21B 43/013* (2013.01)

(58) Field of Classification Search

None

See application file for complete search history.

(56) References Cited

U.S. PATENT DOCUMENTS 4,046,405 A * 9/1977 Bonds ..... E21B 43/10 166/208
4,416,472 A * 11/1983 Fowler ..... E21B 33/043 166/217

(Continued)

FOREIGN PATENT DOCUMENTS

| | | |
|---|---|---|
| EP | 0515742 | 2/1992 |
| GB | 2219643 A | 12/1989 |

OTHER PUBLICATIONS

Dril-Quip "Subsea Tie-Back Systems," 2014, 12 pages.

(Continued)

*Primary Examiner* — Matthew R Buck
*Assistant Examiner* — Douglas S Wood
(74) *Attorney, Agent, or Firm* — Hogan Lovells US LLP

(57) ABSTRACT

A method for tying back a subsea well assembly to a surface platform and a tieback connector used to perform this operation. The tieback connector includes a mandrel having an axis, external threads, an upward facing lip on an external lower end portion of the mandrel, a backup ring having internal threads engaged with the external threads of the mandrel, a sleeve carried on an outside diameter of the backup ring. When the mandrel is rotated relative to the backup ring, the mandrel moves axially upward relative to the sleeve, deforming an annular seal assembly between the upward facing lip of the mandrel and the load bearing surface of the sleeve, thereby creating a seal between the apparatus and the wellhead housing.

20 Claims, 6 Drawing Sheets

(51) Int. Cl.
*E21B 43/013* (2006.01)
*E21B 19/00* (2006.01)

(56) References Cited

U.S. PATENT DOCUMENTS 4,456,070 A * 6/1984 Watkins ..... E21B 33/043 166/344
4,465,134 A * 8/1984 Watkins ..... E21B 33/043 166/123
4,497,368 A 2/1985 Baugh
4,653,589 A * 3/1987 Alandy ..... E21B 33/043 166/208
4,872,708 A * 10/1989 Abreo, Jr. ..... E21B 33/038 166/340
5,259,459 A * 11/1993 Valka ..... E21B 33/038 166/217
5,566,761 A 10/1996 Pallini, Jr. et al.
6,003,602 A 12/1999 Wilkins
6,640,902 B2 11/2003 Baten et al.
7,896,081 B2 * 3/2011 Pallini ..... E21B 33/038 166/338
7,975,771 B2 7/2011 Ford
8,127,853 B2 3/2012 Pallini et al.
8,851,167 B2 * 10/2014 Eriksen ..... E21B 7/20 166/124
2012/0211236 A1 8/2012 Braithwaite
2015/0176358 A1 6/2015 Williams

OTHER PUBLICATIONS

B. L. Danner "Development of an Advanced Subsea Wellhead System Incorporating All Metal-to-Metal Sealing" Offshore Technology Conference, May 7, 1990, Houston, Texas, 10 pages.
PCT Search Report and Written Opinion issued in connection with corresponding PCT Application No. PCT/US2015/052213 on Mar. 18, 2016.

* cited by examiner

INTERNAL TIEBACK WITH OUTER DIAMETER SEALING CAPABILITY

CROSS-REFERENCE TO RELATED APPLICATIONS

This application claims priority to U.S. Provisional Patent Application No. 62/055,238 filed on Sep. 25, 2014, the entire contents of which are incorporated herein by reference.

TECHNICAL FIELD

This invention relates in general to subsea oil and gas well production, and in particular to a tieback connector extending from the subsea well to a platform at the surface.

BACKGROUND

Subsea wells typically have a subsea wellhead assembly at the seafloor. In some installations, a subsea production tree is mounted on the wellhead assembly. The tree has valves connected to flow lines for controlling flow from the well. In another type of installation, a string of tieback conduit extends from the subsea wellhead assembly to a platform at the surface. A surface tree is mounted on the upper end of the tieback conduit. Some riser systems have inner and outer tieback conduits, each of which is run separately and connected by a tieback connector. The inner and outer tieback conduits make up the tieback riser in that type of system.

The inner tieback conduit is installed by connecting a tieback connector to the lower end of the conduit and lowering it into the bore of the subsea wellhead housing assembly. The tieback connector has a locking member that locks to the subsea wellhead housing or to the tapered stress joint at the bottom of the outer tieback conduit. The inner tieback connector also has a seal that seals to an internal component of the subsea wellhead housing assembly. Typical outer tieback connectors are locked to the exterior of the subsea wellhead housing assembly. Other outer tieback connectors are locked to the interior. An internal tieback connector typically has a mandrel with a sleeve on the exterior. The mandrel is connected to the inner tieback conduit and is capable of moving between an upper running-in position and a lower landed position in the subsea wellhead housing. An actuator holds the mandrel in the upper position until the actuator lands on structure in the wellhead housing. Then, downward movement of the inner tieback conduit causes the locking member to engage an internal profile in the subsea wellhead housing assembly.

SUMMARY

One example embodiment is an apparatus for tying back a subsea well assembly to a surface platform, the subsea well assembly having an outer tieback conduit mounted on top of a wellhead housing. The apparatus includes a mandrel having an axis, external threads, and adapted to be lowered through the outer tieback conduit, an upward facing lip on an external lower end portion of the mandrel, a backup ring having internal threads engaged with the external threads of the mandrel, a sleeve carried on an outside diameter of the backup ring, the sleeve having a downward facing load bearing surface located above the upward facing lip on the mandrel, a first locking member carried by the sleeve, the first locking member having a plurality of teeth biased in a radially outward direction and adapted to engage with a corresponding profile located on an inner diameter of the outer tieback conduit as the mandrel is lowered into the outer tieback conduit, an annular seal assembly carried between the load bearing surface of the sleeve and the upward facing lip of the mandrel, the seal assembly adapted to be located within a bore of the wellhead housing when the teeth have engaged the profile in the tieback conduit, and an anti-rotation member that allows the mandrel to rotate relative to the backup ring, the sleeve, and the first locking member once the teeth have engaged the profile in the tieback conduit. When the mandrel is rotated relative to the backup ring, the sleeve, and the first locking member, a portion of the backup ring advances axially relative to the first locking member to a backup position between the mandrel and the first locking member and in engagement with an inner diameter of the first locking member, thereby locking the first locking member in a radially outward position. The rotation of the mandrel causes the mandrel to move axially upward relative to the sleeve, deforming the annular seal assembly between the upward facing lip of the mandrel and the load bearing surface of the sleeve, thereby creating a seal between the apparatus and the wellhead housing.

Another example embodiment is a subsea well apparatus for communicating with a surface platform. The apparatus includes a wellhead assembly including a wellhead housing, an outer tieback conduit mounted on top of the wellhead housing, and an internal tieback connector including a mandrel having an axis, external threads, and adapted to be lowered through the outer tieback conduit, an upward facing lip on an external lower end portion of the mandrel, a locking ring having internal threads engaged with the external threads of the mandrel, a sleeve carried on an outside diameter of the locking ring, the sleeve having a downward facing load bearing surface located above the upward facing lip on the mandrel, a plurality of first dogs carried by the sleeve, the plurality of first dogs having a plurality of teeth biased in a radially outward direction and adapted to engage with a corresponding profile located on an inner diameter of the outer tieback conduit as the mandrel is lowered into the outer tieback conduit, an annular seal assembly carried between the load bearing surface of the sleeve and the upward facing lip of the mandrel, the seal assembly adapted to be located within a bore of the wellhead housing when the teeth have engaged the profile in the outer tieback conduit, and an anti-rotation member that allows the mandrel to rotate relative to the locking ring, the sleeve, and the plurality of first dogs once the teeth have engaged the profile in the outer tieback conduit. When the mandrel is rotated relative to the locking ring, the sleeve, and the plurality of first dogs, a portion of the locking ring advances axially relative to the first dogs to a backup position between the mandrel and the first dogs and in engagement with an inner diameter of the first dogs, thereby locking the first dogs in a radially outward position. The rotation of the mandrel causes the mandrel to move axially upward relative to the sleeve, deforming the annular seal assembly between the upward facing lip of the mandrel and the load bearing surface of the sleeve, thereby creating a seal between the internal tieback connector and the wellhead housing.

Another example embodiment is a method for tying back a subsea well assembly to a surface platform. The method includes lowering an internal tieback connector into an outer tieback conduit mounted on a wellhead housing of the subsea well assembly. The internal tieback connector includes a mandrel having an axis, external threads, and adapted to be lowered through the outer tieback conduit, an upward facing lip on an external lower end portion of the mandrel, a locking ring having internal threads engaged with the external threads of the mandrel, a sleeve carried on an outside diameter of the locking ring, the sleeve having a downward facing load bearing surface located above the upward facing lip on the mandrel, a plurality of first dogs carried by the sleeve, the plurality of first dogs having a plurality of teeth biased in a radially outward direction and adapted to engage with a corresponding profile located on an inner diameter of the outer tieback conduit as the mandrel is lowered into the outer tieback conduit, an annular seal assembly carried between the load bearing surface of the sleeve and the upward facing lip of the mandrel, the seal assembly adapted to be located within a bore of the wellhead housing when the teeth have engaged the profile in the outer tieback conduit, and an anti-rotation member that allows the mandrel to rotate relative to the locking ring, the sleeve, and the plurality of first dogs once the teeth have engaged the profile in the outer tieback conduit. The method also includes engaging the plurality of first dogs with the corresponding profile located on the inner diameter of the outer tieback conduit of the subsea well assembly, and rotating the mandrel relative to the locking ring, the sleeve, and the plurality of first dogs, such that a portion of the locking ring advances axially relative to the first dogs to a backup position between the mandrel and the first dogs and in engagement with an inner diameter of the first dogs, thereby locking the first dogs in a radially outward position, and the rotation of the mandrel causes the mandrel to move axially upward relative to the sleeve, deforming the annular seal assembly between the upward facing lip of the mandrel and the load bearing surface of the sleeve, thereby creating a seal between the internal tieback connector and the wellhead housing.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and therefore are not to be considered limiting of its scope as the invention may admit to other equally effective embodiments.

DETAILED DESCRIPTION

Figure 1:
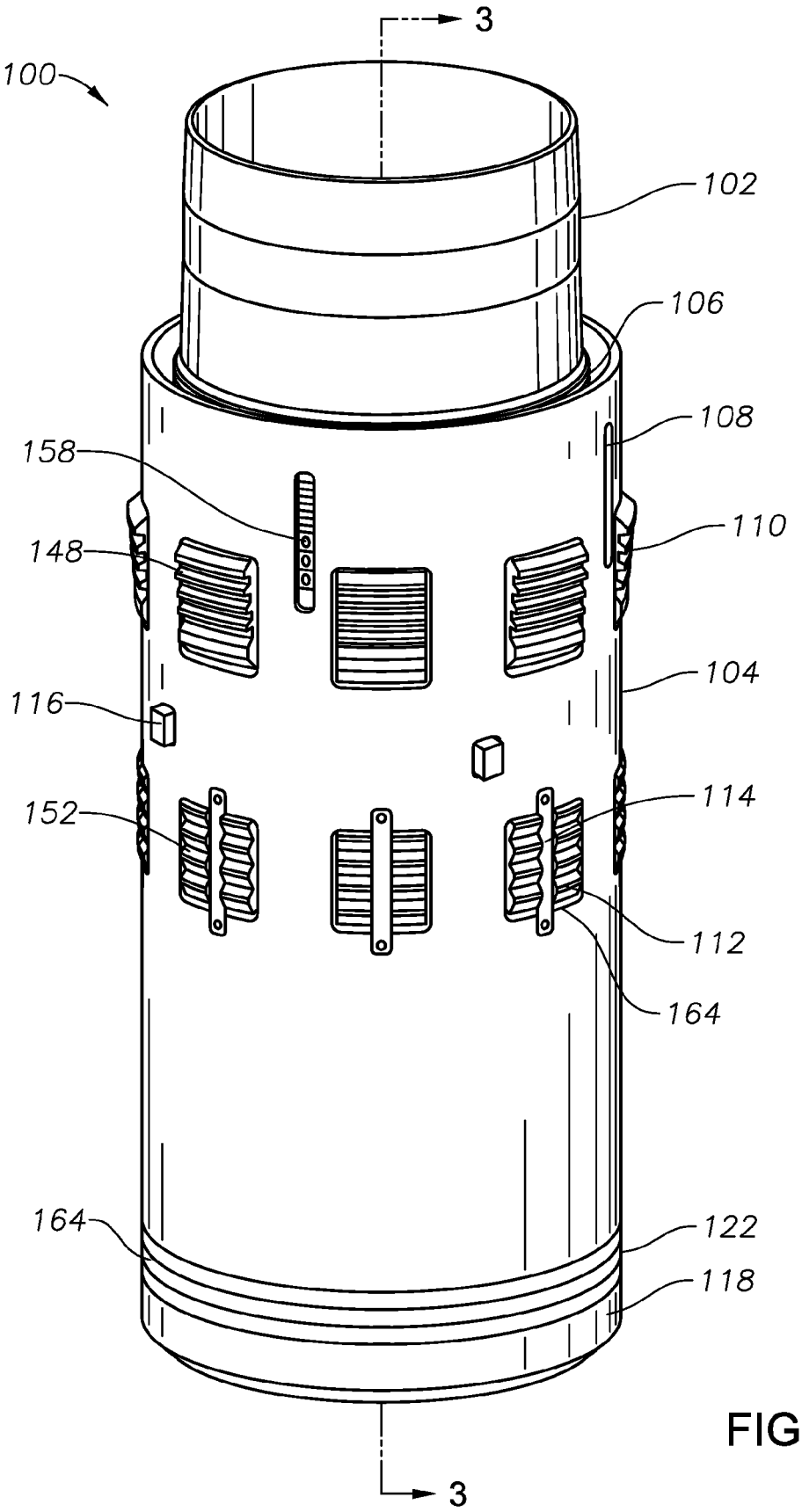
FIG. 1 is a perspective view of an internal tieback connector in accordance with one or more example embodiments of the disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Turning now to the figures, FIG. 1 is a perspective view of an internal tieback connector 100 in accordance with one or more example embodiments of the disclosure. According to this embodiment, the inner tieback conduit (not shown) can be installed by connecting the inner tieback connector 100 to the lower end of the inner conduit and lowering it through the outer conduit and into the bore of the subsea wellhead housing assembly. In embodiments of the present disclosure, the internal tieback connector 100 has a mandrel 102, which is an inner tubular member, that is connected to the inner tieback conduit. The mandrel 102 has a set of external threads 106. The mandrel 102 also includes a lower upward facing lip 118 located on the outer diameter 146 of the mandrel 102 and proximate to a load bearing surface or lower end 150 of the mandrel 102. Lip 118, for example, defines an upward facing external shoulder of the mandrel 102.

A sleeve 104 circumscribes at least a portion of the mandrel 102. The sleeve 104 carries a plurality of first locking members or upper dogs 110 that are spaced around a circumference of the sleeve 104. Each of the upper dogs 110 has a dog body with a series of teeth 148 extending radially outward through an opening, which may be a window, in the sidewall of the sleeve 110. The dogs 110 are secured within an inner diameter of the sleeve 104 and are biased in a radially outward direction. In one example embodiment, the series of teeth 148 extending radially outward is pointing downward so as to restrict upward movement of the external riser (not shown) that the internal tieback connector 100 engages with.

A backup ring or locking ring 120 having internal threads 128 is threaded using threads 106 on to the mandrel 102 and located between the mandrel 102 and the sleeve 104. The locking ring 120 has a portion with an increased outer diameter 156 and portion with a reduced diameter 160. The increased outer diameter 156 can engage an inner diameter of the dog body of the upper dogs 110, locking the upper dogs 110 in a radially outward position so that the upper dogs 110 cannot retract radially inward. Locking ring retainers 158, which may be bolted or screwed into the body of the locking ring 120, are spaced around an outer diameter of the locking ring 120 and extend into axially oriented slots 108 through the sidewall of the sleeve 104. The locking ring retainers 158 are axially shorter than the axial height of the slots 108. This prevents relative rotational movement between the locking ring 120 and the sleeve 104, but will allow for relative axial movement between the locking ring 120 and the sleeve 104.

Internal tieback connector 100 includes a plurality of anti-rotation keys 116 that may be spaced circumferentially around and extend through openings within sleeve 104. Each key 116 is biased outward by a coil spring (not shown) and keys 116 are able to fully retract so that they are flush within the exterior surface of sleeve 104.

Figure 2:
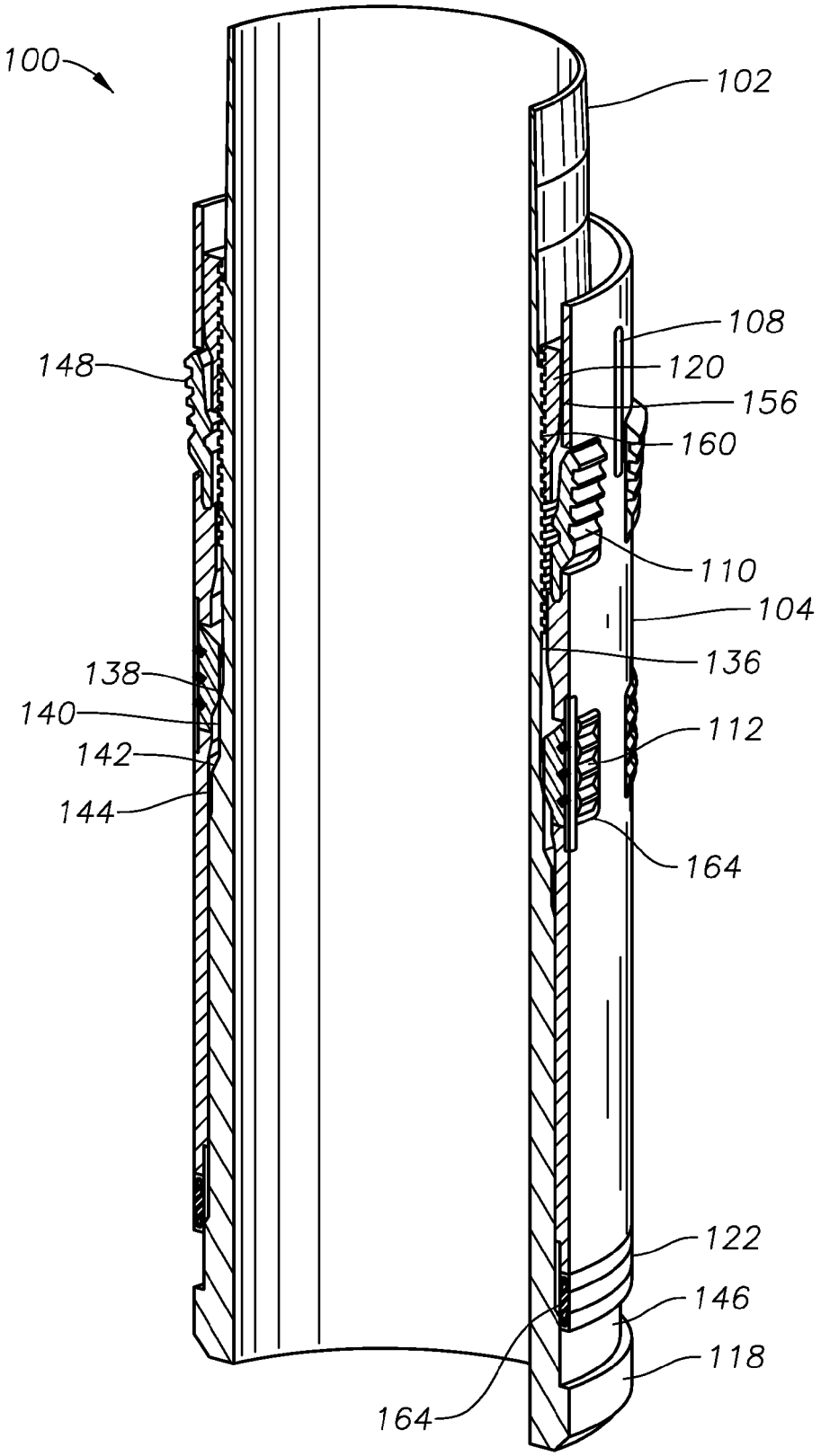
FIG. 2 is a sectional perspective view of the internal tieback connector of FIG. 1, shown in an unlocked position, according to one or more example embodiments of the disclosure.
Figure 3:
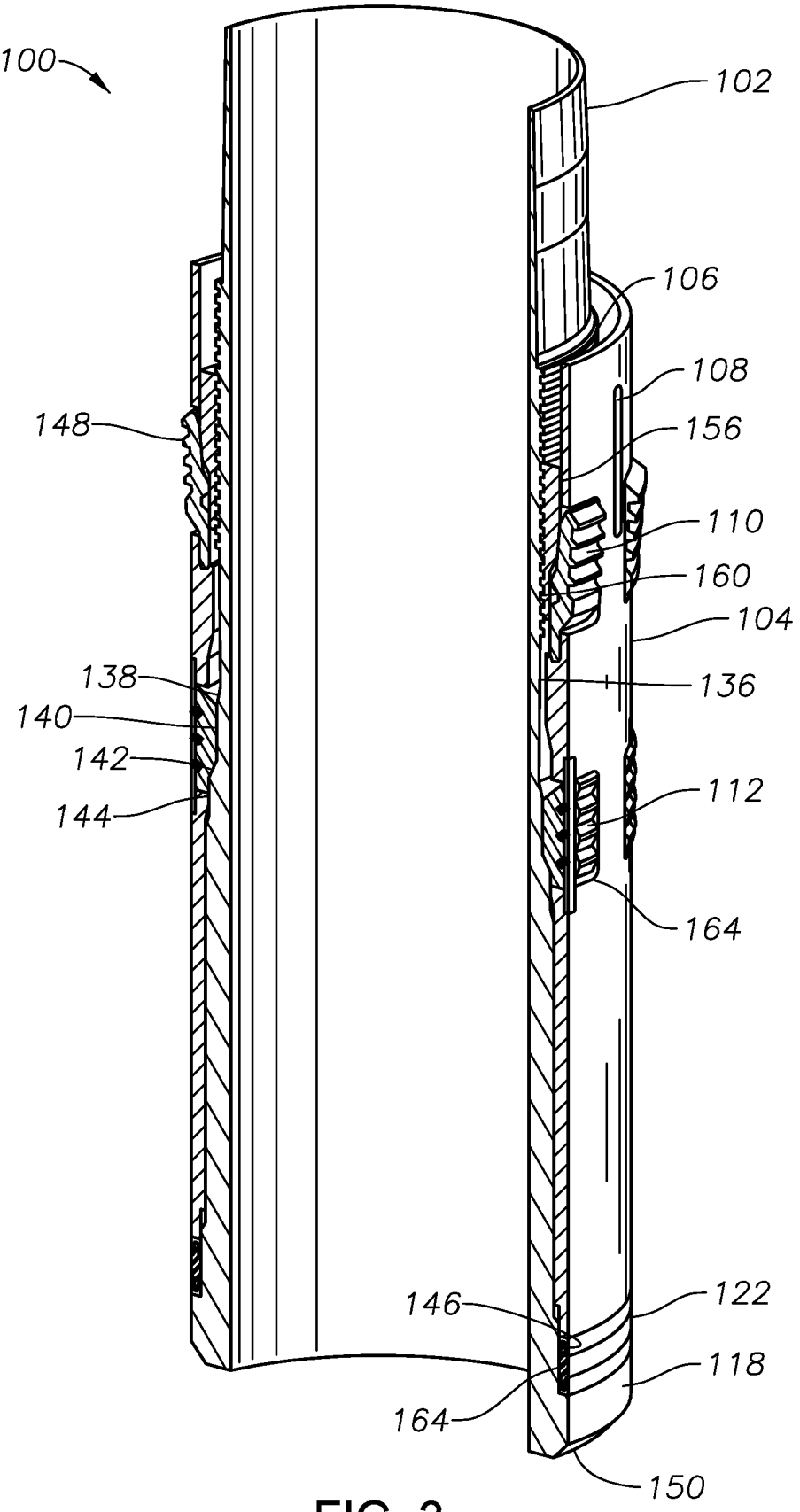
FIG. 3 is a sectional perspective view of the internal tieback connector of FIG. 1, shown in a locked position, according to one or more example embodiments of the disclosure.

The sleeve 104 also carries a plurality of second locking members or lower dogs 112 that are spaced around a circumference of the sleeve 104 and are axially spaced from the upper dogs 110. In the example of FIGS. 1-3, the upper dogs 110 are located axially above the lower dogs 112. Each of the lower dogs 112 has a dog body with a series of teeth 152 extending radially outward through an opening 170, which may be a window, in the sidewall of the sleeve 104. A lower dog retainer 114 extends across each of the lower dogs 112 to retain the lower dog 112 with the sleeve 104. Lower dogs 112 are located on the profile 136 of mandrel 102, and each lower dog 112 has a downward shoulder for engaging the upper 138 and lower 142 shoulder of the mandrel 102. Lower dogs 112 may be supported and biased using one or more springs 126, which may be leaf springs or coil springs. Engaging the upper shoulder 138 of the mandrel 102 and moving axially past the upper shoulder 138 towards the lower shoulder 142 causes the lower dog 112 to move radially outward and be locked in the radially outward position. In one example embodiment, the series of teeth 152 extending radially outward is pointing upward so as to restrict downward movement of the external riser 168 that the internal tieback connector 100 engages with.

FIG. 2 is a sectional perspective view of the internal tieback connector 100 shown in an unlocked position. An annular seal assembly 122 circumscribes the mandrel 102 and is located below a lower end of the sleeve 104. The seal assembly 122 can be compressed between the upward facing lip 118 of the mandrel 102 and the lower end of the sleeve 104. The seal assembly 122 can include two metal to metal seals having an elastomeric seal 164 in between and can be energized by the compression of the seal assembly 122 between the upward facing lip 118 of the mandrel 102 and the lower end of the sleeve 104, creating a seal between the internal tieback connector 100 and the inner diameter of the wellhead housing (not shown). FIG. 3 is an example sectional perspective view of the internal tieback connector 100 shown in a locked position, which will be discussed in further detail below.

Figure 4:
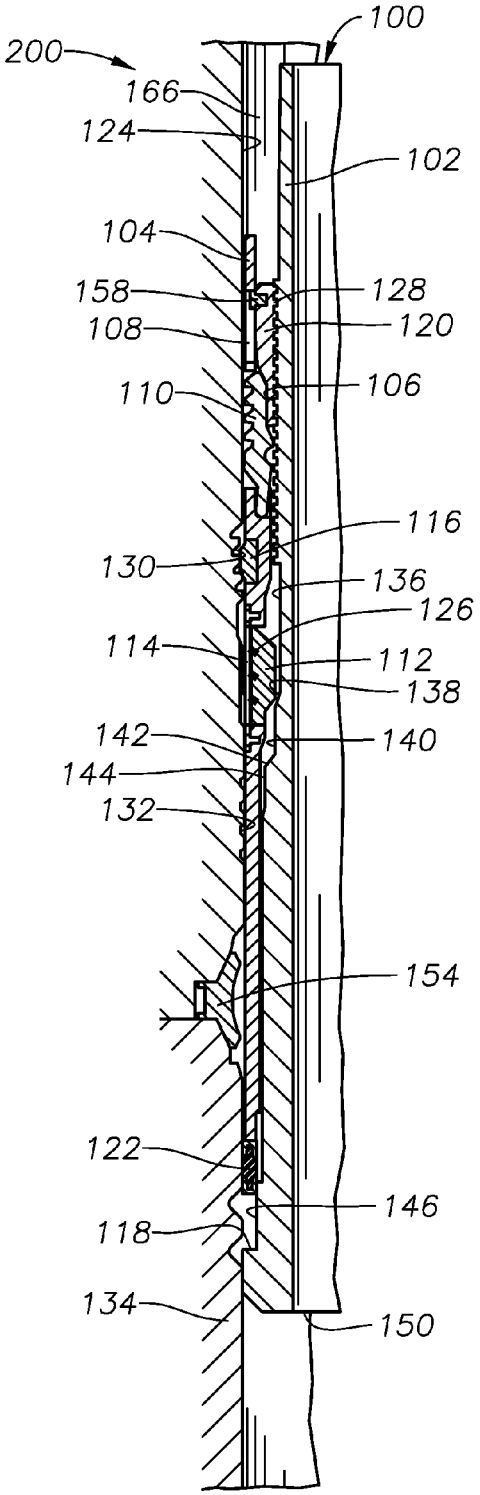
FIG. 4 is a sectional view of an internal tieback connector shown being run into a wellhead assembly, according to one or more example embodiments of the disclosure.
Figure 5:
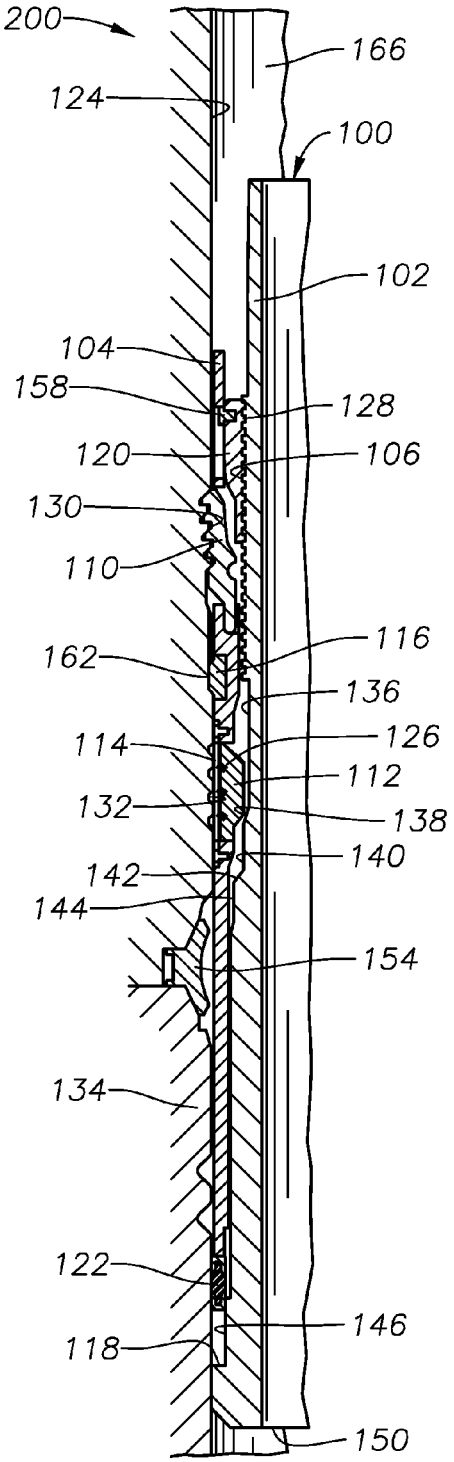
FIG. 5 is a sectional view of an internal tieback connector shown with the upper dogs and the lower dogs engaging the inner diameter of the outer tieback conduit, according to one or more embodiments of the disclosure.
Figure 6:
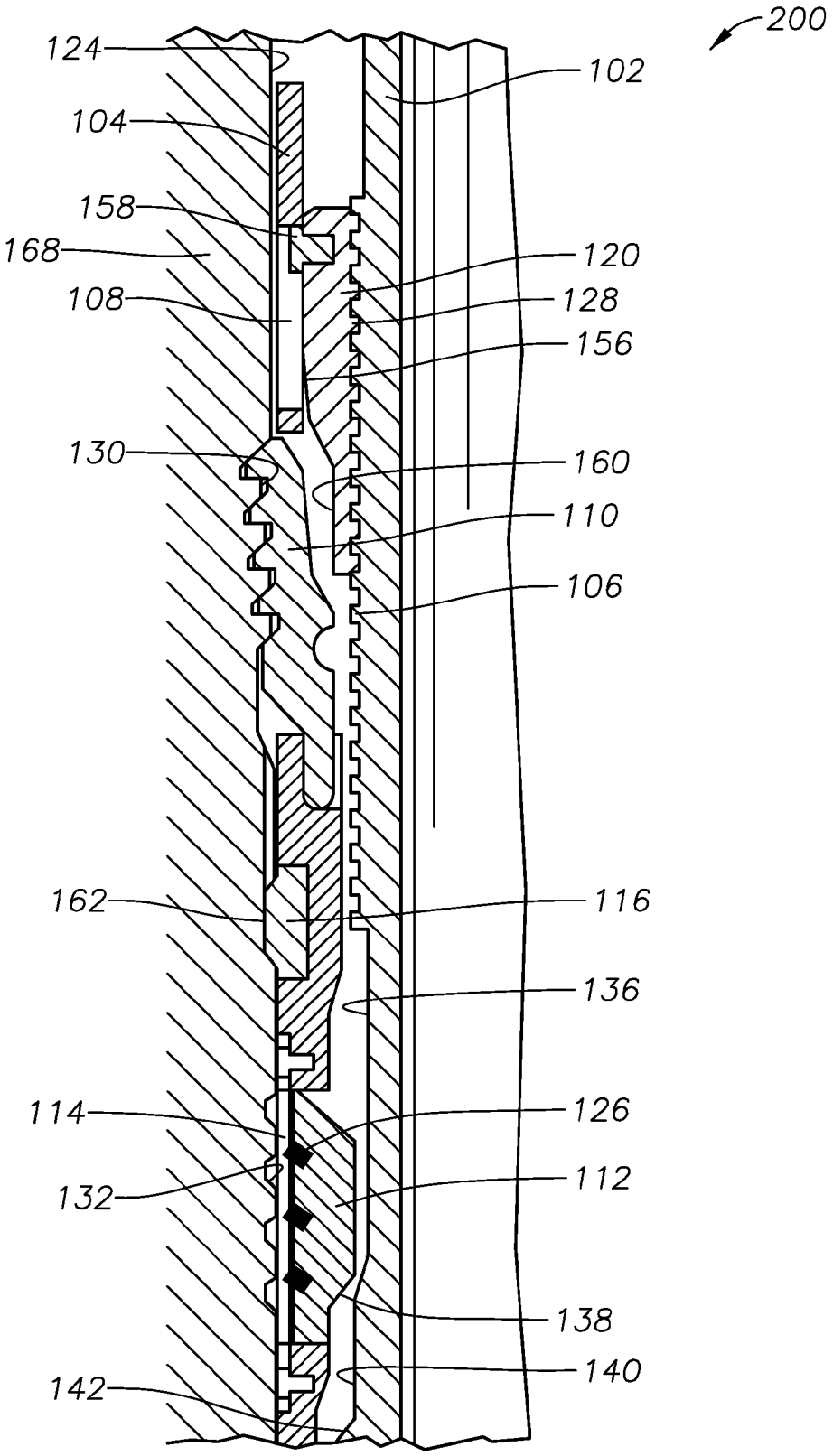
FIG. 6 is a close up sectional view of an internal tieback connector, according to one or more embodiments of the disclosure.

Turning now to FIGS. 4-6, illustrated is an example method for tying back a subsea well assembly to a surface platform using an internal tieback connector 100 in accordance with one or more example embodiments of the disclosure. The internal tieback connector 100 has the mandrel 102, which is an inner tubular member, that is connected to the inner tieback conduit. The mandrel 102 has a set of external threads 106. Axially below the external threads 106 is a circumferential profile or recess 136. The circumferential profile 136 has an upper shoulder 138 defining a transition to a first increased outer diameter 140 of the mandrel 102 and a lower shoulder 142 defining a transition to a second increased outer diameter 144. The mandrel 102 may include additional shoulders defining transitions to further increased outer diameters moving from the circumferential profile 136 to the lower end of the mandrel 150. The mandrel 102 also includes a lower upward facing lip 118 located on the outer diameter 146 of the mandrel 102 and proximate to a lower end 150 of the mandrel 102. Lip 118, for example, defines an upward facing external shoulder of the mandrel 102.

FIG. 4 is a sectional view of an apparatus 200 including the internal tieback connector 100 shown being run into a subsea wellhead housing assembly including an external riser 168 and a wellhead housing 134, according to one or more example embodiments of the disclosure. The external riser 168 is connected to the wellhead housing 134 and a gasket 154 seals between the external riser 168 and gasket 154. The inner diameter of the external riser 168 includes an upper groove profile 130 corresponding to the shape of teeth 148 on upper dogs 110, and a lower groove profile 132 corresponding to the shape of teeth 152 on lower dogs 112. Upper and lower groove profiles 130, 132 include annular grooves in the bore of the tieback conduit 166. However, the grooves within the upper groove profile 130 are pointing upward so as to mate with the teeth 148 on the upper dogs 110, and the grooves within the lower groove profile 132 are pointing downward so as to mate with the teeth 152 on lower dogs 112.

In an example of operation, the internal tieback connector 100 is lowered through the outer tieback conduit 166 so that the end 150 of the internal tieback connector 100 is located within the subsea wellhead housing 134 assembly. The upper dogs 110 are biased in the outward direction and will be pushed inward while passing through the inner diameter 124 of the outer tieback conduit 166 so that they are sliding against the inner diameter 124 of the outer tieback conduit 166. As illustrated in FIG. 5, when the upper dogs 110 reach a corresponding upper profile 130 located on the inner diameter 124 of the outer tieback conduit 166, the upper dogs 110 will snap outward, stopping downward and axial movement of the internal tieback connector 100. Similarly, the lower dogs 112 reach a corresponding lower profile 132 located on the inner diameter 124 of the outer tieback conduit, and the lower dogs 112 snap outward into the corresponding lower profile 132, stopping upward and axial movement of the internal tieback connector 100. At the same time anti-rotation keys 116 snap into engagement with a mating slot 162 formed on an inner diameter of the external riser 168. However, depending on the orientation of the internal tieback connector 100 rotation may be required for the anti-rotation keys 116 to find the mating slots 162. It should also be noted that there may be several mating slots 162 spaced around the bore of external riser 168. Each key 116 may find a mating slot 162 and snap into it to prevent further rotation of sleeve 108.

FIG. 6 illustrates a closer view of the apparatus 200 shown in FIG. 5. As illustrated in this semi-locked position, upper dogs 110 of the internal tieback connector 100 are engaged with the upper profile 130 in the external riser 168 and lower dogs 112 are engaged with the lower profile 132. Anti-rotation keys 116 are engaged with mating slots 162 formed in the inner diameter of the external riser 168.

Figure 7:
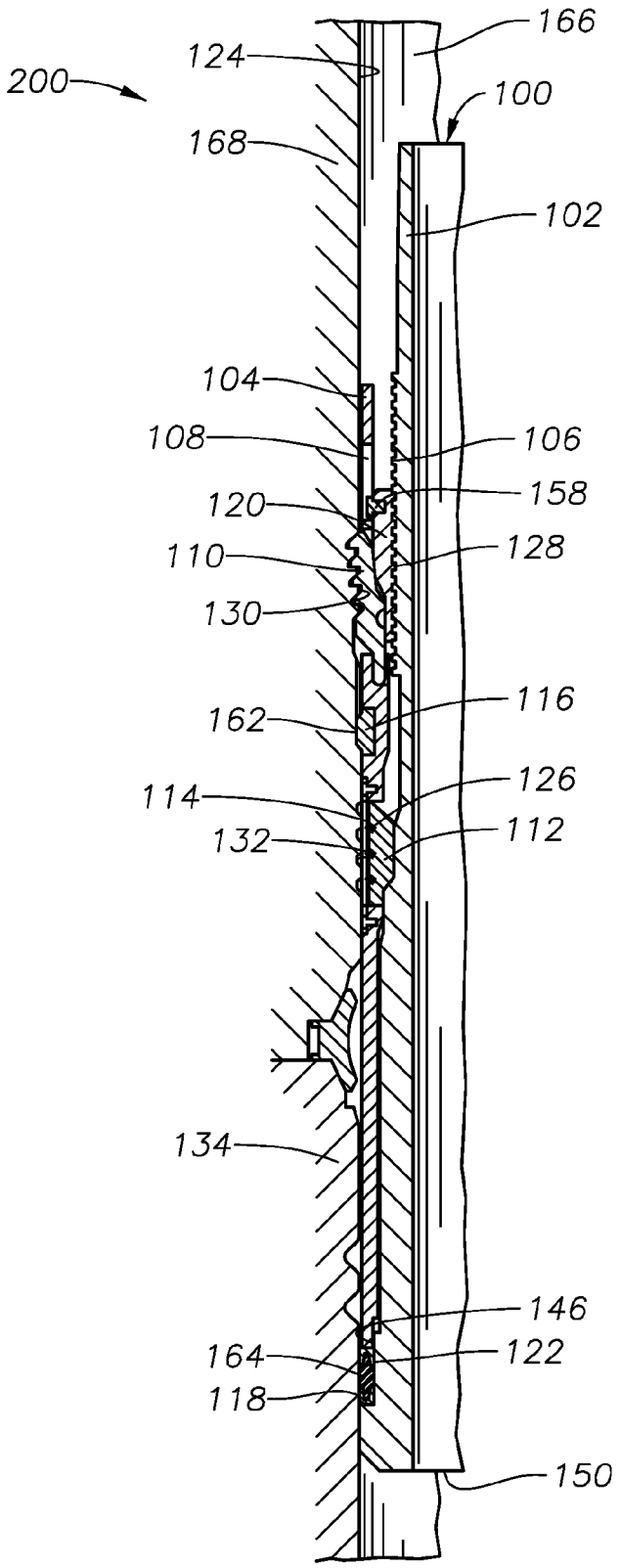
FIG. 7 is a sectional view of an internal tieback connector shown in a set and locked position, according to one or more embodiments of the disclosure.

Moving now to FIG. 7, with the axial movement of the internal tieback connector stopped, the mandrel 102 of the internal tieback connector 100 is now rotated. Since the internal threads 128 of the locking ring 120 are engaged with the external threads 106 of the mandrel 102, the rotation causes the mandrel 102 to move axially upward relative to the sleeve 104. This relative movement energizes the seal assembly 122 by compressing the seal assembly 122 between the upward facing lip 118 of the mandrel and the lower end of the sleeve 104, creating a tight seal between the internal tieback connector 100 and the inner diameter 124 of the wellhead housing 134.

As the mandrel 102 moves upward relative to the sleeve 104, the lower dogs 112 move axially past the upper shoulder 138 towards the lower shoulder 142, causing the lower dogs 112 to move radially outward and to be locked in the radially outward position due to the increase in outer diameter of the mandrel 102 between the two shoulders 138,142. In the radially outward position, the teeth 152 of the lower dogs 112 engage the lower profile 132 located on the inner diameter 124 of the outer tieback conduit 166. This will provide additional capacity for compressive loading in the connector 100. Because an increased diameter of the mandrel 102 is positioned adjacent the lower dogs 112, the lower dogs 112 cannot be retracted radially inward and instead they will remain in engagement with the outer tieback conduit 166.

The rotation additionally causes the locking ring 120 to rotate along the threads 106 of the mandrel 102 and move axially downward along the threads 106 of the mandrel 102. This will cause the larger diameter portion 156 of the locking ring 120 to be located axially adjacent to the dog body of the upper dogs 110 so that the lower dogs 112 are locked in place and cannot be retracted radially inward but will instead remain in engagement with the outer tieback conduit 166. As the rotation is completed a torque build up is achieved through the series of locking dogs 110, 112 driving the metal to metal seal 122 and preloading the connector 100.

One example embodiment is a method for unlocking and retrieving the internal tieback connector 100. In order to unlock and retrieve the internal tieback connector 100, the mandrel 102 of the internal tieback connector 100 is rotated in the opposite direction. This opposite rotation will move the mandrel 102 downward relative to the sleeve 104, un-energize the seal assembly 122, and unlock the upper and lower dogs 110, 112. The internal tieback connector 100 can be rotated until torque is released and then the inner tieback conduit can be pulled back to the surface.

Therefore, example embodiments of this disclosure allow a dual barrier to be installed at almost any time, regardless of casing hanger program. In addition, the inner tieback connector can pass through the outer tieback conduit, and then seal with the inner diameter of a wellhead housing or other wellhead assembly member that has a larger inner diameter than the inner diameter of the outer tieback conduit through which the internal tieback connector is passed.

The terms "inner", "outer", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While example embodiments of the system and method have been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

While the invention has been shown in only some of its forms, it should be apparent to those skilled in the art that it is not so limited, but is susceptible to various changes without departing from the scope of the invention.

The invention claimed is:

1. An apparatus for tying back a subsea well assembly to a surface platform, the subsea well assembly having an outer tieback conduit mounted on top of a wellhead housing, the apparatus comprising:

a mandrel having an axis, external threads, and adapted to be lowered through the outer tieback conduit;

an upward facing lip on an external lower end portion of the mandrel;

a backup ring having internal threads engaged with the external threads of the mandrel;

a sleeve carried on an outside diameter of the backup ring, the sleeve having a downward facing load bearing surface located above the upward facing lip on the mandrel;

a first locking member carried by the sleeve, the first locking member having a plurality of teeth biased in a radially outward direction and adapted to engage with a corresponding first locking member profile located on an inner diameter of the outer tieback conduit as the mandrel is lowered into the outer tieback conduit; and an annular seal assembly carried between the load bearing surface of the sleeve and the upward facing lip of the mandrel;

wherein when the mandrel is rotated relative to the backup ring, the sleeve, and the first locking member, a portion of the backup ring advances axially relative to the first locking member to a backup position between the mandrel and the first locking member and in engagement with an inner diameter of the first locking member, thereby locking the first locking member in a radially outward position; and the rotation of the mandrel causes the mandrel to move axially upward relative to the sleeve, deforming the annular seal assembly between the upward facing lip of the mandrel and the load bearing surface of the sleeve, thereby creating a seal between the apparatus and the wellhead housing.

2. The apparatus according to claim 1, further comprising:

an anti-rotation member that allows the mandrel to rotate relative to the backup ring, the sleeve, and the first locking member once the teeth have engaged the first locking member profile in the outer tieback conduit.

3. The apparatus according to claim 1, wherein the mandrel has a first outer diameter in a first portion and a second outer diameter in a second portion, the first outer diameter being smaller than the second outer diameter and being separated by a shoulder.

4. The apparatus according to claim 1, further comprising:

a second locking member carried by the sleeve, the second locking member having a plurality of teeth biased in a radially outward direction and adapted to engage with a corresponding second locking member profile located on the inner diameter of the outer tieback conduit as the mandrel is lowered into the outer tieback conduit, the second locking member being axially below the first locking member.

5. The apparatus according to claim 1, wherein the plurality of teeth on the first locking member are oriented downwards, thereby locking downward movement of the apparatus.

6. The apparatus according to claim 4, wherein the plurality of teeth on the second locking member are oriented upwards, thereby locking upward movement of the apparatus.

7. The apparatus according to claim 4, wherein the second locking member is supported by a plurality of coil springs or leaf springs.

8. The apparatus according to claim 1, wherein the backup ring is attached to the sleeve using a plurality of anti-rotation keys inserted into a plurality of axially oriented slots in the sleeve.

9. A subsea well apparatus for communicating with a surface platform, the apparatus comprising:

a wellhead assembly comprising a wellhead housing;

an outer tieback conduit mounted on top of the wellhead housing;

an internal tieback connector comprising:

a mandrel having an axis, external threads, and adapted to be lowered through the outer tieback conduit;

an upward facing lip on an external lower end portion of the mandrel;

a locking ring having internal threads engaged with the external threads of the mandrel;

a sleeve carried on an outside diameter of the locking ring, the sleeve having a downward facing load bearing surface located above the upward facing lip on the mandrel;

a plurality of first dogs carried by the sleeve, the plurality of first dogs having a plurality of teeth biased in a radially outward direction and adapted to engage with a corresponding first dog profile located on an inner diameter of the outer tieback conduit as the mandrel is lowered into the outer tieback conduit; and an annular seal assembly carried between the load bearing surface of the sleeve and the upward facing lip of the mandrel;

wherein when the mandrel is rotated relative to the locking ring, the sleeve, and the plurality of first dogs, a portion of the locking ring advances axially relative to the first dogs to a backup position between the mandrel and the first dogs and in engagement with an inner diameter of the first dogs, thereby locking the first dogs in a radially outward position; and the rotation of the mandrel causes the mandrel to move axially upward relative to the sleeve, deforming the annular seal assembly between the upward facing lip of the mandrel and the load bearing surface of the sleeve, thereby creating a seal between the internal tieback connector and the wellhead housing.

10. The apparatus according to claim 9, wherein the mandrel has a first outer diameter in a first portion and a second outer diameter in a second portion, the first outer diameter being smaller than the second outer diameter and being separated by a shoulder.

11. The apparatus according to claim 9, further comprising:

a plurality of second dogs carried by the sleeve, the plurality of second dogs having a plurality of teeth biased in a radially outward direction and adapted to engage with a corresponding second dog profile located on the inner diameter of the outer tieback conduit as the mandrel is lowered into the outer tieback conduit, the second dogs being axially below than the first dogs.

12. The apparatus according to claim 9, wherein the plurality of teeth on the first dogs are oriented downwards, thereby locking downward movement of the internal tieback connector.

13. The apparatus according to claim 12, wherein the plurality of teeth on the second dogs are oriented upwards, thereby locking upward movement of the internal tieback connector.

14. The apparatus according to claim 12, wherein the plurality of second dogs are supported by a plurality of coil springs or leaf springs.

15. The apparatus according to claim 9, further comprising:

an anti-rotation member that allows the mandrel to rotate relative to the locking ring, the sleeve, and the plurality of first dogs once the teeth have engaged the first dog profile in the outer tieback conduit.

16. The apparatus according to claim 9, wherein the locking ring is attached to the sleeve using a plurality of anti-rotation keys inserted into a plurality of axially oriented slots in the sleeve.

17. A method for tying back a subsea well assembly to a surface platform comprising:

lowering an internal tieback connector into an outer tieback conduit mounted on a wellhead housing of the subsea well assembly, the internal tieback connector comprising:

a mandrel having an axis, external threads, and adapted to be lowered through the outer tieback conduit;

an upward facing lip on an external lower end portion of the mandrel;

a locking ring having internal threads engaged with the external threads of the mandrel;

a sleeve carried on an outside diameter of the locking ring, the sleeve having a downward facing load bearing surface located above the upward facing lip on the mandrel;

a plurality of first dogs carried by the sleeve, the plurality of first dogs having a plurality of teeth biased in a radially outward direction and adapted to engage with a corresponding first dog profile located on an inner diameter of the outer tieback conduit as the mandrel is lowered into the outer tieback conduit; and an annular seal assembly carried between the load bearing surface of the sleeve and the upward facing lip of the mandrel;

engaging the plurality of first dogs with the corresponding first dog profile located on the inner diameter of the outer tieback conduit of the subsea well assembly; and rotating the mandrel relative to the locking ring, the sleeve, and the plurality of first dogs, such that a portion of the locking ring advances axially relative to the first dogs to a backup position between the mandrel and the first dogs and in engagement with an inner diameter of the first dogs, thereby locking the first dogs in a radially outward position, wherein the rotation of the mandrel causes the mandrel to move axially upward relative to the sleeve, deforming the annular seal assembly between the upward facing lip of the mandrel and the load bearing surface of the sleeve, thereby creating a seal between the internal tieback connector and the wellhead housing.

18. The method according to claim 17, further comprising:

engaging a plurality of second dogs comprising a plurality of teeth with a corresponding second dog profile located on an inner diameter of an outer tieback conduit of the subsea well assembly, the plurality of second dogs being axially below than the first dogs.

19. The method according to claim 17, wherein the plurality of teeth on the first dogs are oriented downwards, thereby locking downward movement of the internal tieback connector.

20. The method according to claim 18, wherein the plurality of teeth on the second dogs are oriented upwards, thereby locking upward movement of the internal tieback connector.

* * * * *